US008939229B2

(12) United States Patent
Hartmann et al.

(10) Patent No.: US 8,939,229 B2
(45) Date of Patent: Jan. 27, 2015

(54) POWER TOOL

(75) Inventors: Markus Hartmann, Mauerstetten (DE); Frank Kohlschmied, Munich (DE); Christian Daubner, Mammendorf (DE)

(73) Assignee: Hilti Aktiengesellschaft, Schaan (LI)

( * ) Notice: Subject to any disclaimer, the term of this patent is extended or adjusted under 35 U.S.C. 154(b) by 593 days.

(21) Appl. No.: 13/156,608

(22) Filed: Jun. 9, 2011

(65) Prior Publication Data

US 2011/0303430 A1 Dec. 15, 2011

(30) Foreign Application Priority Data

Jun. 10, 2010 (DE) ..... 10 2010 029 918

(51) Int. Cl.
*B25D 9/16* (2006.01)
*B25D 17/06* (2006.01)
*B25D 17/24* (2006.01)

(52) U.S. Cl.
CPC ..... *B25D 17/06* (2013.01); *B25D 17/245* (2013.01); *B25D 2217/0019* (2013.01); *B25D 2250/035* (2013.01); *B25D 2250/365* (2013.01); *B25D 2217/0015* (2013.01)
USPC ..... 173/112; 173/212; 173/201

(58) Field of Classification Search
CPC .... B25D 17/06; B25D 17/245; B25D 11/005; B25D 2217/0019; B25D 2250/035
USPC ..... 173/212, 122, 200, 201, 114, 109, 14; 277/567
See application file for complete search history.

(56) References Cited

U.S. PATENT DOCUMENTS

| | | | | |
|---|---|---|---|---|
| 2,521,248 A | | 9/1950 | Parker | |
| 2,561,009 A | | 7/1951 | Byers et al. | |
| 3,067,584 A | | 12/1962 | Atkinson | |
| 4,442,906 A | * | 4/1984 | Simpson | 173/48 |
| 4,932,479 A | * | 6/1990 | Pyatov | 173/14 |
| 5,556,112 A | * | 9/1996 | Brandt | 277/560 |
| 5,715,681 A | | 2/1998 | Williamson | |

(Continued)

FOREIGN PATENT DOCUMENTS

| | | |
|---|---|---|
| DE | 694 12 278 T2 | 4/1999 |
| EP | 0 133 161 A1 | 2/1985 |

(Continued)

OTHER PUBLICATIONS

European Search Report, dated Sep. 16, 2011, 9 pages.

(Continued)

*Primary Examiner* — Andrew M Tecco
(74) *Attorney, Agent, or Firm* — Crowell & Moring LLP

(57) ABSTRACT

A power tool is disclosed. The power tool has a striker, which is guided along an axis in a guide tube. A pneumatic chamber has a volume which varies with a movement of the striker. The pneumatic chamber is closed by the striker, the guide tube and a valve device. The valve device has in a flow channel a sealing element that is moveable between two positions in a bearing along the axis. The flow channel has a first cross-sectional area in a first of the two positions of the sealing element adjacent to a first mating surface of the bearing, and the flow channel has a second cross-sectional area in a second of the two positions of the sealing element adjacent to second mating surface of the bearing offset from the first mating surface along the axis. The second cross-sectional area is greater than the first cross-sectional area.

13 Claims, 8 Drawing Sheets

(56) References Cited

U.S. PATENT DOCUMENTS

| | | | | |
|---|---|---|---|---|
| 5,775,440 | A * | 7/1998 | Shinma | 173/109 |
| 6,227,309 | B1 * | 5/2001 | Henke et al. | 173/201 |
| 6,237,699 | B1 * | 5/2001 | Plietsch et al. | 173/201 |
| 7,198,275 | B2 * | 4/2007 | Gravier | 277/438 |

FOREIGN PATENT DOCUMENTS

| | | | |
|---|---|---|---|
| EP | 0 933 169 | A2 | 8/1999 |
| GB | 2 084 917 | A | 4/1982 |
| WO | WO 2010/082871 | A1 | 7/2010 |

OTHER PUBLICATIONS

German Search Report, dated Dec. 20, 2012, 5 pages.

U.S. Patent Application, "Power Tool", filed Jun. 9, 2011, Inventor Markus Hartmann, et al, U.S. Appl. No. 13/156,603.

U.S. Patent Application, "Power Tool and Control Method", filed Jun. 9, 2011, Inventor Frank Kohlschmied, et al, U.S. Appl. No. 13/156,592.

* cited by examiner

POWER TOOL

This application claims the priority of German Patent Document No. 10 2010 029 918.9, filed Jun. 10, 2010, the disclosure of which is expressly incorporated by reference herein.

BACKGROUND AND SUMMARY OF THE INVENTION

The present invention relates to a power tool, in particular a hand-operated chiseling power tool.

In the case of hand-held chiseling power tools, chiseling action is supposed to be suspended when a chisel is lifted off a workpiece. In the case of striking mechanisms that operate pneumatically, a pneumatic spring can be deactivated by means of additional ventilation openings, which are only opened if the chisel is disengaged. A striker, also called an intermediate striking device or anvil, is supposed to remain away from the ventilation openings for this purpose after an empty impact. However, this is not the case to some extent due to the rebound of the striker on a forward limit stop.

A power tool according to the invention has a striker, which is guided along an axis in a guide. A pneumatic chamber has a volume which varies with a movement of the striker along the axis. A pneumatic chamber is closed by the striker, the guide and a valve device actuated by its own medium. The volume of the pneumatic chamber varies with a movement of the striker along the axis. The valve device actuated by its own medium has, in a flow channel between the striker and the guide, a sealing element that is moveable between two positions in a bearing along the axis. The flow channel has a first cross-sectional area in a first of the two positions of the sealing element adjacent to a first mating surface of the bearing, and the flow channel has a second cross-sectional area in a second of the two positions of the sealing element adjacent to a second mating surface of the bearing offset from the first mating surface along the axis. The second cross-sectional area is greater than the first cross-sectional area. The valve device actuated by its own medium may have, for example, a groove embedded in the striker or in the guide, and a sealing element. The sealing element is moveable in the groove along the axis between a first and a second groove wall. The flow channel of the valve device has the first cross-sectional area in a first position of the sealing element adjacent to the first groove wall and the second cross-sectional area in a second position of the sealing element adjacent to the second groove wall, which is greater than the first cross-sectional area. Adjacent to the first groove wall, the sealing element closes or throttles an air flow into or out of the pneumatic chamber. The striker experiences a braking effect because of the closed pneumatic chamber when it slides back into the tool receptacle. Adjacent to the second groove wall, a greater air flow through the second cross-sectional area of the flow channel is possible. In the case of a movement in the impact direction, the valve device makes a pressure equalization possible in the pneumatic chamber, which is why no braking effect occurs.

One embodiment provides that a volume of the pneumatic chamber is increasing in the case of a movement of the striker in the impact direction and the first mating surface of the bearing is facing the pneumatic chamber, e.g., the groove with the second groove wall is arranged facing the pneumatic chamber. In the case of an air flow out of the pneumatic chamber, the sealing element is pushed in the direction of the mating surface of the bearing facing the pneumatic chamber. With this first variant, air is able to flow into the pneumatic chamber, when the striker moves forward and the volume increases. When the volume of the pneumatic chamber is decreasing in the case of a movement of the striker in the impact direction, the second mating surface of the bearing is facing the pneumatic chamber, e.g., the groove with the first groove wall is arranged facing the pneumatic chamber. A further embodiment provides for two pneumatic chambers, which are connected by the valve device actuated by its own medium.

One embodiment provides that the flow channel runs between the first mating surface of the bearing and a first mating surface of the sealing element assigned to the first mating surface of the bearing and between the second mating surface of the bearing and a second mating surface of the sealing element assigned to the second mating surface of the bearing. The first cross-sectional area of the flow channel is determined by the space between the first mating surfaces of the bearing and the sealing element, when these are adjacent to each other. The second mating surface of the bearing and/or a mating surface, that is the second mating surface, of the sealing element assigned to the second mating surface of the bearing may have narrow channels running at least in part radially, i.e., perpendicularly, to the axis. The narrow channels define a second cross-sectional area that is greater than zero and make an air exchange possible into or out of the pneumatic chamber, even if the sealing element is adjacent to the second groove wall. The two second mating surfaces of the bearing and of the sealing element close flush only in part, e.g., due to the narrow channels. The second cross-sectional area is not equal to zero and an airflow may flow through the flow channel. If the two first mating surfaces are flush with each other, the first cross-sectional area is equal to zero. The groove and the sealing element may run annularly around the axis and, in the first position, the sealing element touches the guide and the striker respectively along a closed line around the axis.

One embodiment provides that a channel runs from the first groove wall to the second groove wall between a groove base of the groove and the sealing element. The flow channel of the valve runs between the sealing element and the body in which the groove is introduced.

In one embodiment, the first groove wall is inclined with respect to the axis by less than 60 degrees and the second groove wall is inclined with respect to the axis by at least 80 degrees.

One embodiment provides that the first cross-sectional area of the flow channel is a maximum of one tenth of the second cross-sectional area of the flow channel.

One embodiment provides that the striker has a prismatic first section and a second section with a larger cross-sectional area as compared to the first section, wherein the valve device is arranged in the second section of the striker. Bodies having a cross-section that is constant along an axis, e.g., cylinders, are prismatic.

One embodiment provides that a seal between the striker and the guide and that is offset from the valve device actuated by its own medium along the axis for sealing the pneumatic chamber is provided, wherein the valve device actuated by its own medium and the seal are arranged at different distances from the axis.

One embodiment has a throttle, which connects the pneumatic chamber with an air reservoir. An effective cross-sectional area of the pneumatic chamber, defined by the differential of the volume of the pneumatic chamber in the impact direction is greater than one hundred times a cross-sectional area of the throttle. The striker is moved parallel to the axis, whereby a volume change of the pneumatic chamber is produced proportional to the displacement along the axis and the effective cross-sectional area. The effective cross-sectional area can be determined by the mathematical operation of differentiation in the movement or impact direction. In the case of a cylindrical guide and a cylindrical striker, the effective cross-sectional area corresponds to the largest cross-sectional area perpendicular to the axis. The ratio of the effective cross-sectional area of the pneumatic chamber to the cross-sectional area of the throttle determines a relative flow speed of the air in the throttle related to the speed of the striker. Starting at this relative flow speed, the air can escape quickly enough from the pneumatic chamber without a drop in pressure developing with respect to the environment. It was recognized that an absolute speed of the air in the throttle cannot be exceeded. However, the throttle appears to block a limit value of the absolute speed. The ratio of a hundred times, preferably three-hundred times, is selected so that, in the case of a striker driven by the striking mechanism, the absolute speed of the air in the throttle is reached; in the case of a striker moved manually, the absolute speed is fallen short of considerably. As a result, the throttle blocks when the striker strikes, and opens when the striker is moved manually.

In one embodiment, the valve device may be configured as a throttle valve device. An effective cross-sectional area of the pneumatic chamber defined by the differential of the volume of the pneumatic chamber in the impact direction is greater than a hundred times of a cross-sectional area of the flow channel. The first mating surface of the bearing and/or a mating surface of the sealing element assigned to the first mating surface of the bearing may have narrow channels running radially perpendicularly to the axis at least in part. A total of their cross-sectional area is less than one hundredth of the effective cross-sectional area of the pneumatic chamber.

One embodiment has a pneumatic striking mechanism, which is arranged percussively with its impacting piston in the impact direction on the striker. The striker is an impact body or an anvil moveable along the axis, which is arranged between a striking device of a pneumatic striking mechanism and a tool inserted into a tool receptacle.

The following description explains the invention on the basis of exemplary embodiments and figures.

DETAILED DESCRIPTION OF THE DRAWINGS

Unless otherwise indicated, the same or functionally equivalent elements are identified in the figures by the same reference numbers.

Figure 1:
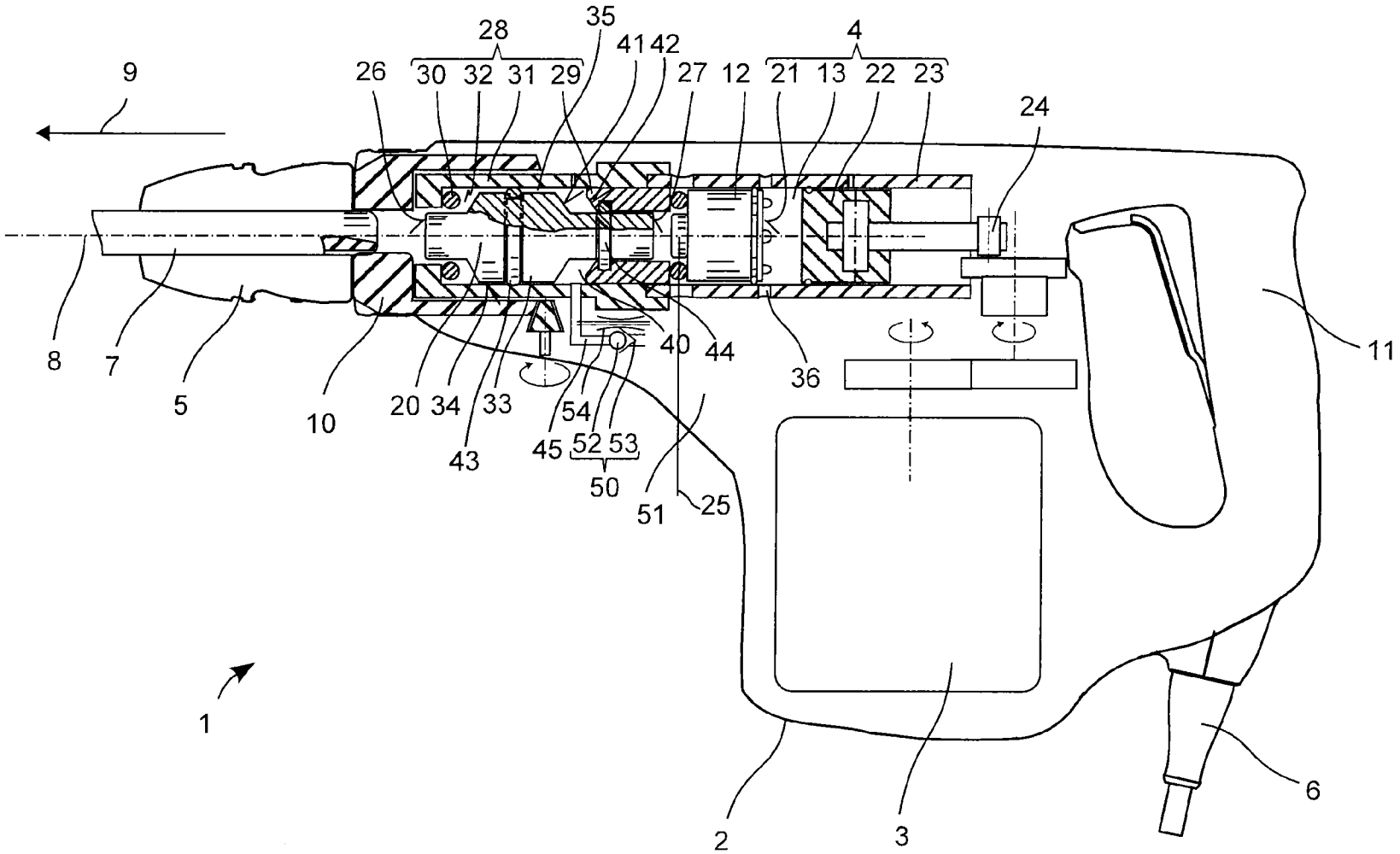
FIG. 1 illustrates a hand-held power tool with a pneumatic striking mechanism and a striker brake.

FIG. 1 shows a hammer drill 1 as an embodiment for a chiseling power tool. The hammer drill 1 has a machine housing 2, in which a motor 3 and a pneumatic striking mechanism 4 driven by the motor 3 are arranged, and a tool receptacle 5 is preferably fastened in a detachable manner. The motor 3 is an electric motor, for example, which is supplied with electricity by a cable-based power supply 6 or a chargeable battery system. The pneumatic striking mechanism 4 drives a tool 7 inserted into the tool receptacle 5, e.g., a boring tool or a chisel, away from the hammer drill 1 along an axis 8 in the impact direction 9 into a workpiece. The hammer drill 1 optionally has a rotary drive 10, which can rotate the tool 7 around the axis 8 in addition to the impacting movement. One or two hand grips 11 are fastened on the machine housing 2, which make it possible for a user to operate the hammer drill 1. A purely chiseling embodiment, e.g., a chisel hammer, differs from the hammer drill 1 essentially only by the lack of the rotary drive 10.

The pneumatic striking mechanism 4 depicted exemplarily has an impacting piston 12, which is induced by an excited pneumatic spring 13 to move forward, i.e., in the impact direction 9, along the axis 8. The impacting piston 12 hits a striker 20 and thereby releases a portion of its kinetic energy to the striker 20. Because of the recoil induced by the pneumatic spring 13, the impacting piston 12 moves backward, i.e., against the impact direction 9, until the compressed pneumatic spring 13 again drives the impacting piston 12 forward. The pneumatic spring 13 is formed by a pneumatic chamber, which is closed axially at the front by a rear face surface 21 of the impacting piston 12 and axially at the rear by an exciter piston 22. In the radial direction, the pneumatic chamber can be closed circumferentially by an impacting tube 23, in which the impacting piston 12 and the exciter piston 22 are guided along the axis 8. In other designs, the impacting piston 12 may slide in a cup-shaped piston, wherein the exciter piston closes the hollow space of the pneumatic chamber in the radial direction, i.e., circumferentially. The pneumatic spring 13 is excited by a forced, oscillating movement along the axis 8 of the exciter piston 22. An eccentric drive 24, a wobble drive, etc., can convert the rotational movement of the motor 3 into the linear, oscillating movement. A period of the forced movement of the exciter piston 22 is coordinated with the interplay of the system of the impacting piston 12, pneumatic spring 13 and striker 20 and their relative axial distances, in particular a predetermined impact point 25 of the impacting piston 12 with the striker 20 in order to excite the system resonantly and thus optimally for energy transmission from the motor 3 to the impacting piston 12.

The striker 20 is a body, preferably a rotating body, with a front impact surface 26 exposed in the impact direction 9 and a rear impact surface 27 exposed against the impact direction 9. The striker 20 transmits an impact on its rear impact surface 27 to the tool 7 adjacent to its front impact surface 26. In terms of its function, the striker 20 may also be designated as an intermediate striking device.

A guide 28 guides the striker 20 along the axis 8. In the depicted example, the striker 20 dips partially with a rear end into a rear guide section 29. The rear end is adjacent with its radial outer surface to the guide section 29 in the radial direction. A forward guide section 30 can likewise enclose a forward end of the striker 20 and restrict its radial movement. The rear and forward guide sections 29, 30 together form two limit stops, which limit an axial movement of the striker 20 on a path between the rear limit stop 29 and the forward limit stop 30 situated in the impact direction 9 (striker limit stop). The striker 20 has a thickened center section 33, whose face surfaces strike against the guide sections 29, 30. The guide 28 depicted exemplarily has, for example, a cylindrical, circumferentially closed guide tube 31, in which is the striker 20. The thicker section 33 of the striker 20 is spaced apart radially with its lateral surface 34, i.e., radial outer surface, at least in sections or along its entire circumference from an inner wall 32 of the guide tube 31. A channel-like or cylindrical gap 35 between the striker 20 and the guide tube 31 runs over the entire axial length of the center thickened section 33. The gap 35 may have a radial dimension of between 0.5 mm and 4 mm for example.

Figure 2:
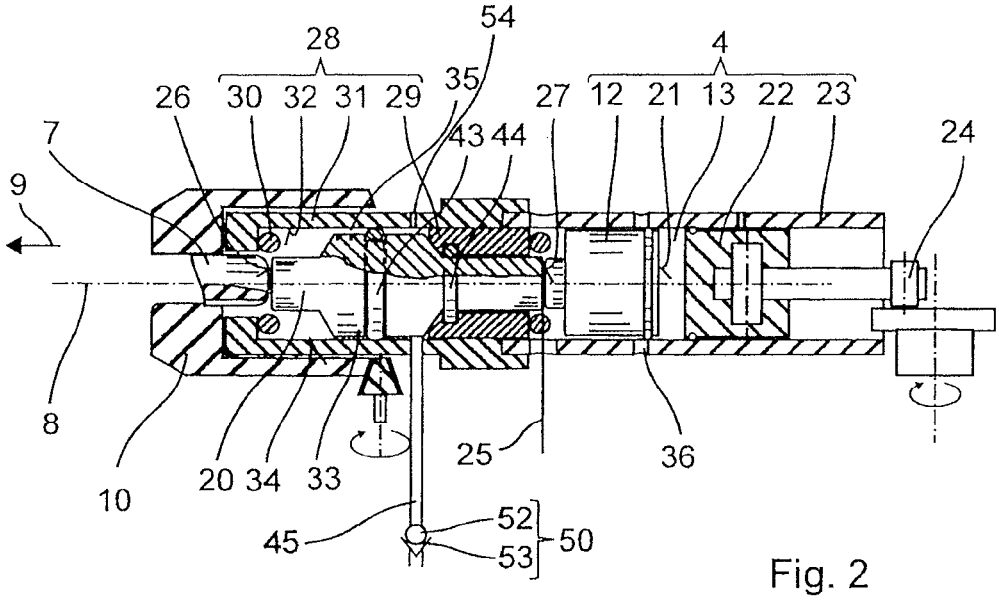
FIG. 2 illustrates the pneumatic striking mechanism in the operating position.

During chiseling, the tool 7 supports itself on the forward impact surface 26 of the striker 20, whereby the striker 20 is kept engaged on the rear limit stop 29 (FIG. 2). The striking mechanism 4 is designed for the engaged position of the striker 20. The predetermined impact point 25 (FIG. 2) of the impacting piston 12 and the reversal point in the movement of the impacting piston 12 is determined by the rear impact surface 27 of the engaged striker 20.

As soon as a user removes the tool 7 from the workpiece, the impacting function of the pneumatic striking mechanism 4 is supposed to be interrupted, because otherwise the hammer drill 1 will idle percussively. When the impacting piston 12 impacts the striker 20, the striker 20 slides to the forward limit stop 30 and preferably stands still in its vicinity. The impacting piston 12 may move forward beyond the predetermined impact point 25 in the impact direction 9 up to the preferably dampening limit stop 30. In the advanced position beyond the impact point 25, the impacting piston 12 frees a ventilation opening 36 in the impact tube 23, through which the pneumatic chamber of the excited pneumatic spring 13 is connected and ventilated with preferably the environment in the machine housing 2. The effect of the pneumatic spring 13 is reduced or reversed, which is why the impacting piston 12 stands still because of the weakened or missing connection to the exciter piston 22. The striking mechanism 4 is reactivated, if the striker 20 is engaged up to the rear limit stop 29 and the impacting piston 12 closes the ventilation opening 36.

So that the striker 20 remains preferably in the vicinity of the forward limit stop 30 after an empty impact, the striker 20 can essentially move unchecked in the impact direction 9 to the forward limit stop 30; in the opposite direction from the rear limit stop 29, the movement occurs, however, against a spring force of at least one pneumatic spring 40. The spring force of the pneumatic spring 40 is controlled as a function of the movement direction of the striker 20 related to the guide 28.

An at least partially radially running surface of the striker 20 and an at least partially radially running surface of the guide 28 form inner surfaces of the pneumatic chamber 40, which are oriented perpendicularly or inclined to the axis 8. An axial distance of the two radially running surfaces changes with the movement of the striker 20, and therefore, the volume of the pneumatic chamber 40. The change in volume causes a change in the pressure within the pneumatic chamber 40.

A rear bounce surface 41 of the thicker section 33 that points opposite from the impact direction 9 can form the first radially running inner surface of the pneumatic chamber 40. A rear bounce surface 42 of the guide 28 pointing in the impact direction 9, which together with the rear bounce surface 41 of the thicker section 33 defines the rear limit stop 29, can be the second radially running inner surface of the pneumatic chamber 40.

In the radial direction, the pneumatic chamber 40 is closed on one side by the guide 28 and on the other side by the striker 20. A hermetic air-tight seal between the striker 20 and the guide 28 is realized by a first sealing element 43 and a second sealing element 44. The sealing elements 43, 44 are arranged offset from one another along the axis 8. The first sealing element 43 is arranged, for example, between the two limit stops 29, 30, and the second sealing element 44 is arranged axially outside of the two limit stops 29, 30, i.e., of the respective bounce surfaces 42. Located between the two sealing elements 43, 44 are the radially running inner surfaces of the pneumatic chamber 40. In the depicted embodiment, the sealing elements 43, 44 are arranged on sections of the striker 20 having different cross-sections, whereby the distances of the sealing elements 43, 44 to the axis 8 are different sizes. In other embodiments, at least sections of the sealing elements 43, 44 are at different distances from the axis 8. In a projection onto a plane perpendicular to the axis 8, the two seals do not overlap or at least not in sections.

The dependence of the pneumatic spring 40 on the movement direction of the striker 20 is achieved in that at least one of the sealing elements 43, 44 is configured as a valve 50. An air channel 45 links the pneumatic chamber 40 to an air reservoir in the environment, e.g., the machine housing 2. The valve 50, which controls an air flow through the channel 45, is arranged in the channel 45. Control takes place as a function of the movement of the striker 20. When the striker 20 moves in the impact direction 9, the valve 50 opens and air can flow in from the reservoir through the channel 45 into the enlarging volume of the pneumatic chamber 40; the pneumatic spring is herewith deactivated. The valve 50 blocks the channel 45 when the striker 20 moves against the impact direction 9. The pressure in the pneumatic chamber 40 rises with the reducing volume of the pneumatic chamber 40, whereby the pneumatic spring 40 works against the movement of the striker 20.

In one embodiment, the valve 50 is configured as an automatic valve or a valve 50 actuated by its own medium, e.g., a check valve or a throttle check valve. The valve 50 is actuated by an air flow, which flows into the valve 50. The air flow is a result of the pressure difference between the pneumatic chamber 40 and the space 51 connected to it via the valve 50. The connected space 51 may be a very large air reservoir, e.g., the environment, the inside of the machine housing 51, or another closed, pneumatic chamber with a limited volume.

In the depicted embodiment, the pneumatic spring 40 presses a sealing closure body 52 of the valve 50 against a valve opening 53 or valve seat of the valve 50, thereby hermetically closing the valve opening 53. When the pressure within the space 51 linked by the valve 50 overcomes the pneumatic spring 40, i.e., exceeds the pressure within the pneumatic chamber 40, the closure body 52 is pressed away from the valve opening 53. Air can flow through the valve opening 53 along the air channel 45 into the pneumatic chamber 40.

With the movement of the striker 20, the volume of the pneumatic chamber 40 changes in proportion to the speed of the striker 20 and to the annular cross-sectional area of the volume enclosed by the pneumatic chamber 40. In an opened state, the valve 50 has at its narrowest point perpendicular to the flow direction an opening with a cross-sectional area (hydraulic cross section), which preferably does not fall short of 1/30, e.g., 1/20, or 10% of the effective cross-sectional area of the pneumatic chamber 40. The displaced air flows through the opened valve 50 with approximately 30-times, respectively 20-times, 10-times the speed of the striker 20.

A throttle opening 54 can ventilate the pneumatic chamber 40. The throttle opening 54 can be a borehole through the wall of the guide tube 31 for example. The surface of a flow cross-section (hydraulic cross-section) of the throttle opening 54 is smaller by at least two orders of magnitude than the annular cross-sectional area of the pneumatic chamber 40, e.g., less than 0.5 percent. The throttle opening 54 is, for example, greater than 1/2000 or 1/1500 of the annular cross-sectional area in order to make a manual insertion of the striker 20 possible. The flow cross-section or the cross-sectional area of the throttle opening 54 is determined at its narrowest point perpendicular to the flow direction. If the throttle 54 is supposed to equalize the volume change without a pressure change, the displaced air must pass through the throttle 54 at a speed that is at least a hundred times the speed of the striker. The flow characteristics of air set an upper limit for the flow speed, which is why a pressure equalization is possible with a slow moving but not with a rapidly moving striker 20.

The speed of the striker 20 in the impact direction 9 is approximately in the range of 1 m/s to 10 m/s in the case of an empty impact. The volume of the pneumatic chamber 40 increases correspondingly rapidly. Air flows through the opened valve 50 into the pneumatic chamber 40 at a high rate so that a pressure equalization quickly adjusts. When the striker 20 is reflected on the striker limit stop 30, its speed against the impact direction 9 can be in the same order of magnitude. The valve 50 closes and the compression of the closed pneumatic chamber 40 brakes the striker 20. The throttle opening 54 allows only a low airflow to escape, thereby maintaining the overpressure in the pneumatic chamber 40. In the case of a slow movement of less than 0.2 m/s against the impact direction 9, typical for a new application of the chisel, the air may escape through the throttle opening 54 at a rate adequate to facilitate a pressure equalization. As an alternative to a separate throttle opening 54, the valve 50 may be designed as a throttle valve, which leaves open an appropriate throttle opening in a closed/throttling position.

Figure 3:
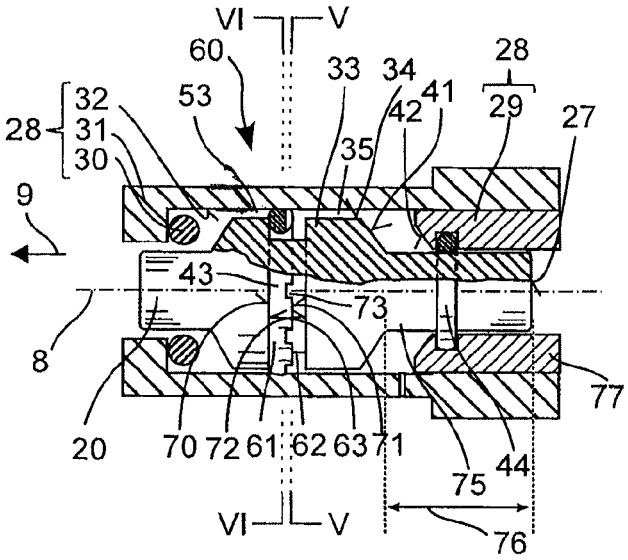
FIG. 3 illustrates the striker brake with a chamber and the moved valve in the braking position.
Figure 5:
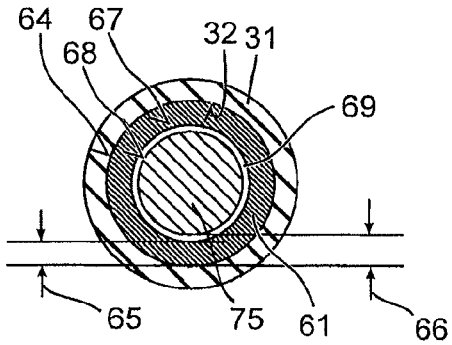
FIGS. 5 and 6 are cross-sections of planes V-V and VI-VI of FIG. 3 and FIG. 4.
Figure 4:
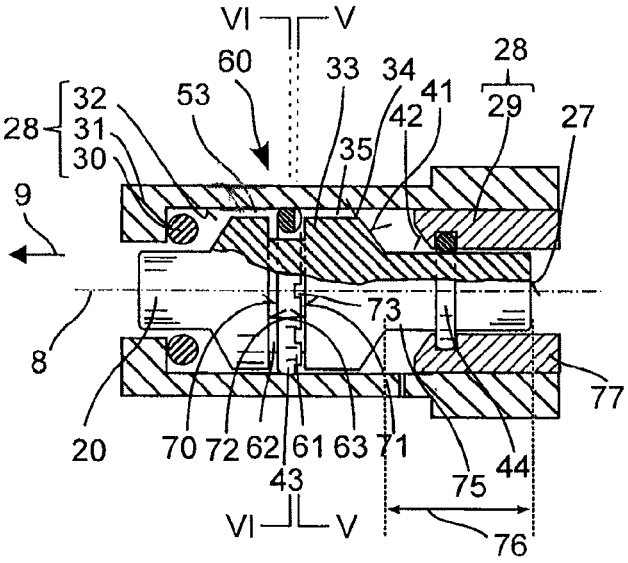
FIG. 4 illustrates the striker brake from FIG. 3 in the released position.
Figure 6:
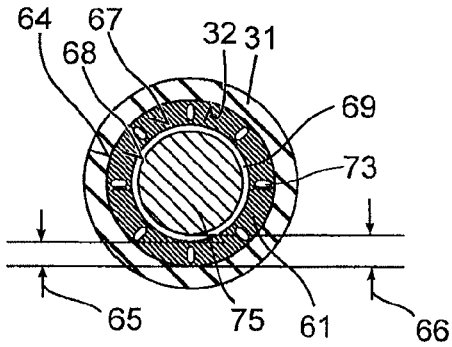

FIG. 3 and FIG. 4 show an exemplary embodiment with a valve 60 in a closed or open state. FIG. 5 and FIG. 6 are cross-sections through the valve 60 of planes V-V or VI-VI. The valve 60 has as the closure body 52 a sealing ring 61, i.e., an annular sealing element, which is inserted into a circumferentially running groove 62 in the thicker section 33 of the striker 20. The gap 35 between the striker 20 and guide tube 31 is divided by the sealing ring 61 and the groove 62 into two sections along the axis 8, which corresponds to the air channel 45 divided by the valve 50. Depending upon the position of the sealing ring 61, air can flow along the gap 35. The sealable valve opening is defined by a seat for the sealing ring 61 in the region of a forward groove wall 63 of the groove 62, i.e., situated in the impact direction 9.

The sealing ring 61 is, for example, an elastic O-ring made of natural or synthetic rubber. A surface pointing radially outwardly, called the radial outer surface 64 of the sealing ring 61 in the following, consistently abuts the inner wall 32 of the guide tube 31 along the entire circumference of the sealing ring 61 so that the sealing ring 61 and the guide tube 31 are hermetically sealed together. The sealing ring 61 may be used in the guide tube 31 in a radially pre-tensioned manner in order to support the airtight seal. A thickness 65 of the sealing ring 61, i.e., a difference from the outer radius to the inner radius, is preferably less than a depth 66 of the groove 62. A surface pointing radially inwardly, called the radial inner surface 67 of the sealing ring 61 in the following, is spaced apart in the radial direction from a groove base 68 of the groove 62 at least in a section along the circumference of the thicker section 33. Situated between the groove base 68 and the sealing ring 61 is a gap 69, through which air may flow along the axis 8.

In the closed or hermetically sealed state of the valve 60, the sealing ring 61 is adjacent with a forward face surface 70, i.e., pointing in the impact direction 9, to the forward groove wall 63 of the groove 62 (FIG. 3). The forward groove wall 63 and the forward face surface 70 touch each other at least along an annular closed line around the axis 8. The forward face surface 70 may be flattened, for example, in order to terminate on a surface of the groove wall 63 with the same inclination, e.g., perpendicular, to the axis 8. A hermetic seal of the valve 60 is produced by the pairwise hermetic sealing of the sealing ring 61 with the groove wall 63, i.e., with the striker 20, or with the guide tube 31, i.e., with the guide 28. The movement of the striker 20 against the impact direction 9 stabilizes the valve 60 in the closed state. In the pneumatic chamber 40 closed by the valve 60, the pressure increases as compared with the environment, thereby pressing the sealing ring 61 against the forward groove wall 63.

In the opened state, the sealing ring 61 is adjacent with a rear face surface 71, i.e., pointing against the impact direction 9, to the rear groove wall 72 of groove 62 (FIG. 4). A distance of the forward groove wall 63 to the rear groove wall 72 is dimensioned in such a way that the sealing ring 61 disengages from the forward groove wall 63 at least in sections along the circumference, when the sealing ring 61 is adjacent to the rear groove wall 72. For example, the distance between the groove walls is greater than a dimension of the sealing ring 61 along the axis 8. The sealing ring 61 moves along the axis 8 from the forward groove wall 63 to the rear groove wall 72.

The rear groove wall 72 and/or the rear face surface 70 of the sealing ring 61 are structured in such a way that a contact surface along which they touch is interrupted by at least one continuous channel lying in the contact surface from the groove base 68 to the guide tube 31. For example, one or more radially running narrow channels 73 are provided in the rear face surface 71. The sealing ring 61 touches the rear groove wall 72 only in sections along the circumference and air can flow through the narrow channels 73. A channel through the open valve 60 therefore runs along the forward face surface 72, the radial inner surface 67 and the narrow channels 73. The movement of the striker 20 in the impact direction 9 stabilizes the valve 60 in the open state. In the pneumatic chamber 40, the pressure drops below the ambient pressure, e.g., in the space 51, and the pressure gradient causes air to flow in and press the sealing ring 61 on the rear groove wall 72. As an alternative or addition to the narrow channels 73 in the sealing ring 61, radially running narrow channels may be embedded in the rear groove wall 72. The air may flow along these narrow channels, and bridges between the narrow channels prevent the narrow channels from being sealed by the sealing ring 61.

The rear face surface 71 may have other structures instead of narrow channels 73, which define channels from the radial inner surface 67 to the radial outer surface 64. The channels may run strictly radially or in addition partially along the circumference of the sealing ring 61. For example, rigid knobs may be provided which maintain the channels against the forces occurring with a forward movement of the striker 20.

Figure 7:
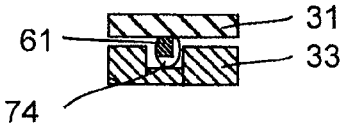
FIG. 7 is a detailed view of FIG. 4.

The sealing ring 61 may have narrow channels 74 on one of its radial inner surfaces (FIG. 7). This makes it possible to use a sealing ring 61 adjacent to the groove base.

In one embodiment, the sealing ring 61 has a throttling effect when the forward face surface 70 is adjacent to the forward groove wall 63. A low air flow can flow through between the face surface 70 and the forward groove wall 63. Thin radial channels may be introduced in the forward face surface 70 for this. The effective total cross-sectional area of the channels is less than the effective total cross-sectional area of the channels 73 in the rear face surface 71. A cross-sectional area perpendicular to the air flow of the thin channels is restricted to a maximum of one hundredth of all perpendicular cross-sectional areas of the narrow channels 73 added up over all narrow channels 73 to be the air flow.

The first sealing element 43 in the embodiment is realized by the valve 60 moved between the limit stops 29, 30. The second sealing element 44 is arranged axially offset from the rear limit stop 29 against the impact direction 9 and, for example, is mounted in a stationary manner in the guide 28. The second sealing element 44 is preferably configured to be annular, e.g., as an O-ring made of rubber. The striker 20 has a cylindrical rear section 75, which is guided through the second sealing element 44 consistent with its inner radial surface. The length 76 of the rear cylindrical section 75 is preferably dimensioned in such a way that at least one portion of the rear section 75 sticks into the second sealing element 44 when the striker 20 is adjacent to the forward limit stop 30 in order to hermetically seal the pneumatic chamber 40 in every position of the striker 20. The length 76 of the rear section 75 is at least longer than the path of the striker 20 between the forward limit stop 30 and the rear limit stop 29.

The second sealing element 44 may be inserted, for example, in a cylindrical sleeve 77, which is then introduced into the guide tube 31. The forward face surfaces of the sleeve 77 may form the mating surfaces 42 for the rear limit stop 29. The cross-sectional area of the sleeve 77 may essentially determine the cross-sectional area of the pneumatic chamber 40. The second sealing element 44 may alternatively be fastened on the rear section 75 of the striker 20, e.g., in an annular groove. The sleeve 77 is provided with a preferably smooth cylindrical inner wall along which the second sealing element 44 slides.

A diameter of the rear section 75 is less than a diameter of the thicker section 33, whereby the valve device 60 is arranged at a greater distance from the axis 8 than the second sealing element 44.

The forward groove wall 70 may be inclined with respect to the axis 8, e.g., by between 45 degrees and 70 degrees. The inclined groove wall 70 can spread the sealing ring 61 in order to support a tight fit on the forward groove wall 70.

Figure 8:
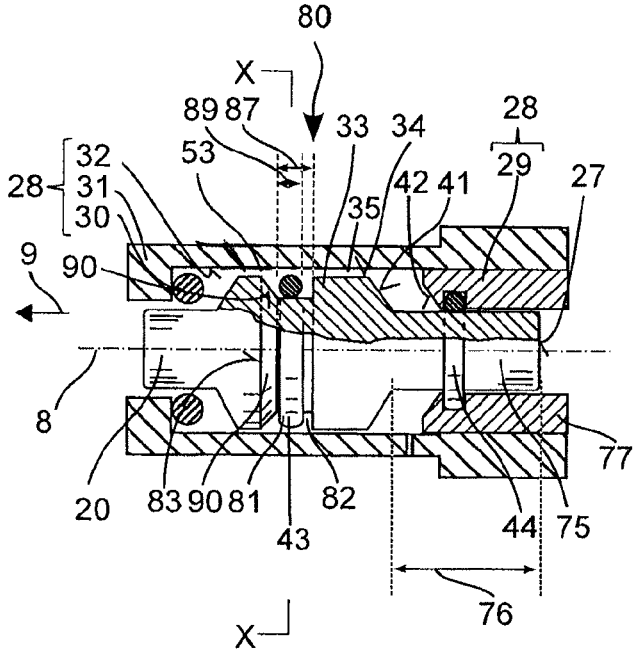
FIGS. 8 to 11 illustrate an additional striker brake.
Figure 10:
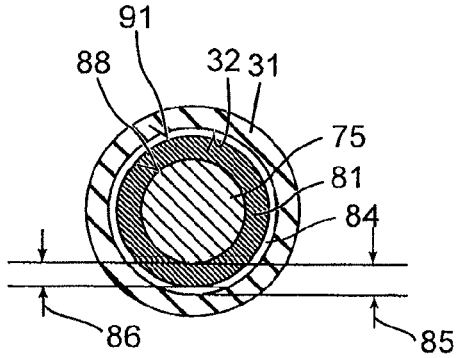
Figure 9:
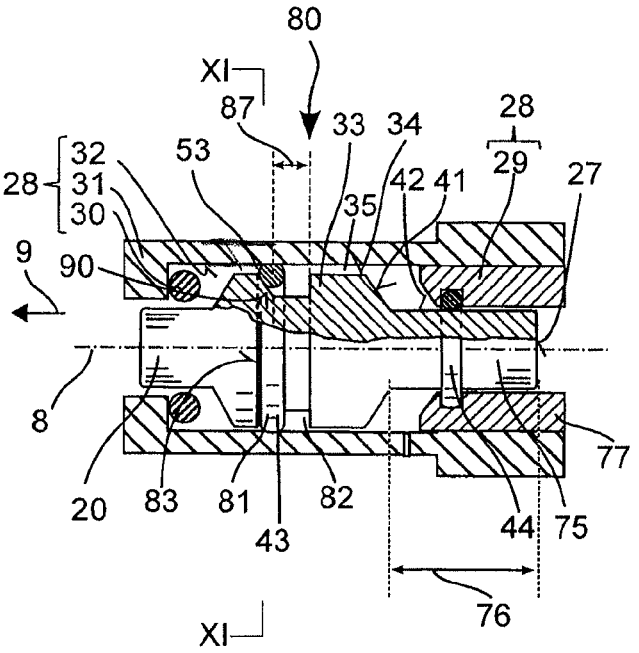
Figure 11:
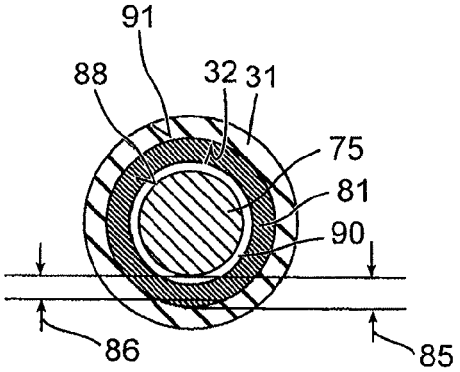

FIG. 8 and FIG. 9 show an exemplary embodiment with a valve 80 in a closed or open state. FIG. 10 and FIG. 11 are cross-sections through the valve 80 of planes X-X or XI-XI. The valve 80 has as the closure body a sealing ring 81, which is inserted into a circumferentially running groove 82 in the thicker section 33 of the striker 20. The gap 35 between the striker 20 and guide tube 31 forms the channel 45, which is divided by the groove 82 and the sealing ring 81 along the axis 8. In the region of a forward groove wall 84 of the groove 82, the sealing ring 81 can seal the channel 45.

The groove 82 can accommodate the sealing ring 81 in such a way that the sealing ring 81 is spaced apart from the inner wall 32 of the guide tube 31 (FIG. 8), i.e., there is an air gap 84 between the sealing ring 81 and the guide tube 31. To this end, a depth 85 of the groove 82 may be at least as great as a thickness 86 of the sealing ring 81. A length 87 of a groove base 88 may be selected to be at least as great as a length 89 of the sealing ring 81 along the axis 8. The groove base 88 essentially runs parallel to the axis 8 and is cylindrical. Air may flow in along the gap 35 into the pneumatic chamber 40.

A forward groove wall 90 is inclined with respect to the axis 8 and preferably defines a conical surface whose radius increases in the impact direction 9. In a closed state of the valve 80, the sealing ring 81 is slid onto the conical forward groove wall 90. The sealing ring 81 in this case is spread radially and its outside diameter increases at least enough that the radial outer surface 91 of the sealing ring 81 touches the inner wall 32 of the guide tube 31 (FIG. 9). A hermetic seal is produced between the striker 20 and the guide 28 by its pairwise, hermetically sealing contact with the sealing ring 81.

The pressure conditions with a backward movement of the striker 20 push the sealing ring 81 onto the conical forward groove wall 90 and thereby cause the valve 80 to close automatically. In the case of a forward movement, the sealing ring 81 disengages from the conical forward groove wall 90, relaxes into its basic form with a smaller outside diameter and releases the air gap 84 to open the valve 80.

The sealing ring 81 is, for example, an elastic O-ring made of natural or synthetic rubber. The sealing ring 81 may be formed to be symmetrical to a plane perpendicular to the axis 8, i.e., having identical face surfaces.

The second sealing element 44 may be arranged axially offset from the rear limit stop 29 against the impact direction 9 and, for example, may be a sealing ring mounted in a stationary manner in the guide 28. Alternatively, the second sealing element 44 may be mounted on the rear section 75 of the striker 20.

Figure 12:
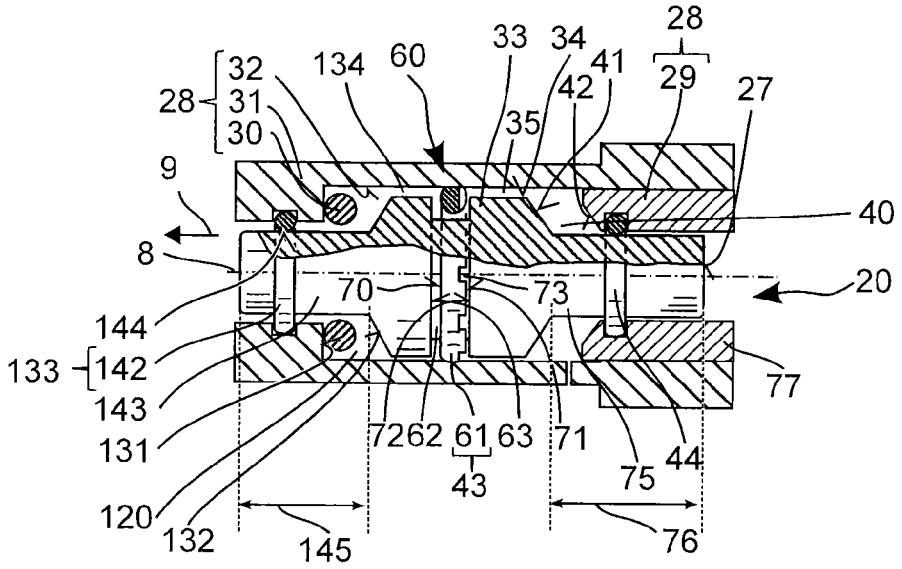
FIGS. 12 and 13 illustrate a striker brake with two chambers.

FIG. 12 shows an embodiment with the valve 60, which pneumatically couples the forward pneumatic chamber 120 and the rear pneumatic chamber 40. Reference is made to the embodiments in connection with the valve 60 for a description of the elements, particularly those related to the rear pneumatic chamber 40. The air channel 134 between the two pneumatic chambers 40, 120 is completely arranged within the guide 28.

A forward bounce surface of the thicker section 33 of the striker 20 forms the rear inner wall 132 of the forward pneumatic chamber 120 and the rear bounce surface of the thicker section 33 forms the forward inner wall 41 of the rear pneumatic chamber 40. The forward inner wall 131 of the forward pneumatic chamber 120 may be formed by a region of the guide 28 defining the forward limit stop 30. An elastic damping element 30 made of rubber, e.g., an O-ring, may also be arranged in the forward pneumatic chamber 120, which damping element softens an impact of the striker 20 in the forward limit stop 30. Projections of the two inner walls 131, 132 of the forward pneumatic chamber 120 onto a plane perpendicular to the axis 8 are essentially the same. The rear inner wall 42 of the rear pneumatic chamber 40 may be formed by a surface of the guide 28 defining the rear limit stop 29. Projections of the two inner walls 41, 42 of the rear pneumatic chamber 40 onto a plane perpendicular to the axis 8 are essentially the same. In the case of a movement of the striker 20, the axial distances between the inner walls of each of the pneumatic chambers 40, 120 change and consequently their volumes. The total of the two volumes may be constant, wherefore the surfaces of the forward inner walls projected onto the plane perpendicular to the axis 8 and the correspondingly projected surfaces of the rear inner walls are the same size.

The gap 35 between the striker 20 and the guide tube 31 forms the air channel 134 between the pneumatic chambers 40, 120. Narrow channels running along the axis 8 in the lateral area 34 of the thicker section 33 may form additional air channels.

The valve 60 on the thicker section 33 blocks against an air flow from the rear pneumatic chamber into the forward pneumatic chamber 120 and opens for an air flow from the forward pneumatic chamber into the rear pneumatic chamber 40. The design of the valve 60 may be taken from the foregoing descriptions.

The third sealing element may be a sealing ring 142 made of rubber, which is arranged axially offset from the forward limit stop 30 in the impact direction 9. The third sealing element 133 may be inserted, for example, into a groove in the guide tube 31. The striker 20 has a cylindrical, forward section 143, which is consistently guided through the third sealing element 133 with its inner radial surface 144. The length 145 of the forward cylindrical section 143 is preferably dimensioned such that at least one portion of the forward section 143 sticks in the third sealing element 133, when the striker 20 is adjacent to the rear limit stop 29 in order to hermetically seal the forward pneumatic chamber 120 in every position of the striker 20. When the striker 20 is adjacent to the forward limit stop 30, the forward section 143 projects over the third sealing element 133 in the impact direction 9 by at least a length corresponding to the path of the striker 20 between the forward limit stop 30 and the rear limit stop 29. A diameter of the forward section 143 is less than the diameter of the thicker section 33.

Figure 13:
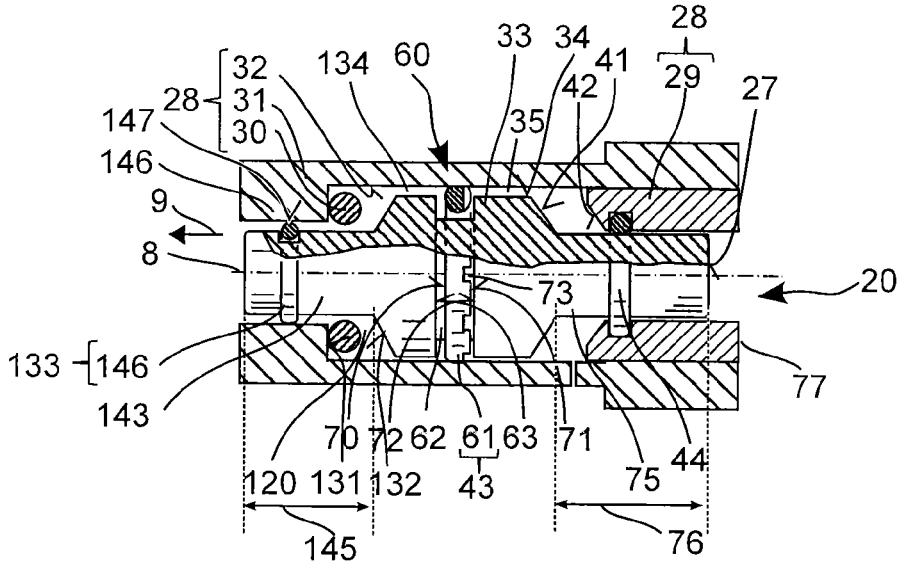

In an alternative embodiment, the sealing ring 146 is fastened on the forward section 143 of the striker 20, e.g., in an annular groove (as shown in FIG. 13). The sealing ring 146 slides within a cylindrical sleeve 147 in the guide 28 and with it seals in every position of the striker 20. An outer radial surface of the sealing ring 146 touches the sleeve 147.

Instead of or in addition to the one-way valve 60 with an axially floating sealing ring 61, other one-way valve systems may be arranged on the thicker section 33, e.g., those described with a conical connecting member for a sealing ring 80, a flap valve, a gap sealing valve.

Figure 14:
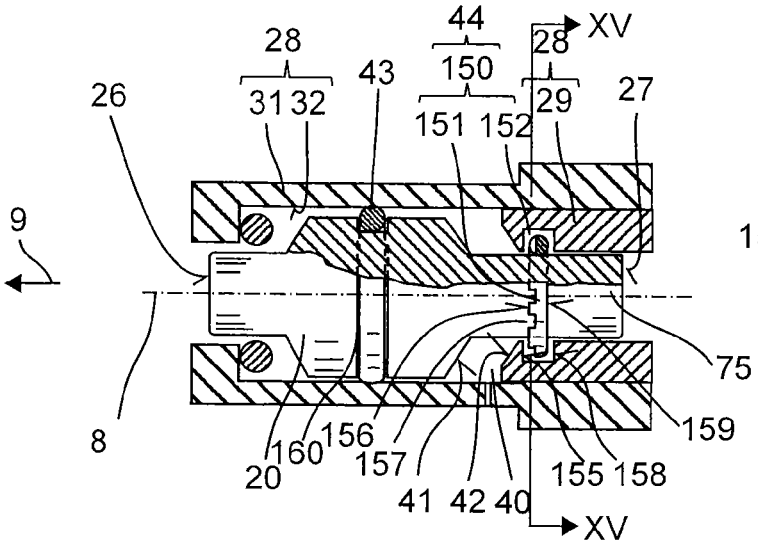
FIGS. 14 and 15 illustrate a striker brake and stationary sealing element.
Figure 15:
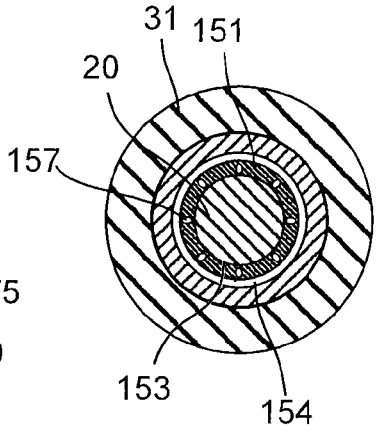

FIG. 14 and FIG. 15 show another embodiment with a valve 150 in a longitudinal section or a cross-section of plane XVIII-XVIII. The valve 150 is mounted in a stationary manner in the guide 28 and forms the second sealing element 44. The alignment of the valve 150 with respect to the impact direction 9 is altered when compared to the previous embodiments, because the valve 150 is arranged as viewed from the tool behind the pneumatic chamber 40.

The design of the valve 150 corresponds to a large extent to the design of the embodiment explained in conjunction with valve 50 embodiment. The single essential difference is the opposite orientation of the valve 150 with respect to the impact direction 9 as compared to the valve 50. Both valves 50 make it possible for air to flow into the pneumatic chamber 40 and prevent air from flowing out. The valve 150 has a sealing ring 151, which is mounted in a circumferential groove 152 in the guide 28. The sealing ring 151 encloses the rear section 75 of the striker 20 in a flush and air-tight manner.

There is a gap 154 between a groove base 153 of the groove 152 and the sealing ring 151, through which gap air can flow in along the axis 8. The groove 152 is wider than the sealing ring 151 in order to make movement of the sealing ring 151 along the axis 8 possible. A forward groove wall 155 and a forward face surface 156 of the sealing ring are structured in such a way that, when the sealing ring 151 is adjacent to the forward groove wall 155, radial channels 157 remain free between the sealing ring 151 and the forward groove wall 155. The channels 157 may be stamped into the forward face surface 156 of the sealing ring 151 as narrow channels for example. The rear groove wall 158 of the groove 152 and the rear face surface 159 of the sealing ring 151 may be hermetically sealed together along a closed circular line around the axis 8. In the case of the forward movement of the striker 20, the sealing ring 151 is pressed against the forward groove wall 155, also supported by the air flowing along the rear section 75 of the striker 20 into the pneumatic chamber 40, whereby the valve 150 is opened or kept open. In the case of a backwards movement of the striker 20, the sealing ring 151 is pressed against the rear groove wall 158, also supported by the overpressure building up in the pneumatic chamber 40, whereby the valve 150 is closed or kept closed.

The first sealing element 43 between the limits stops may be realized, for example, by a sealing ring made of rubber, e.g., an O-ring, which is inserted into an annular groove 160 in the thicker section 33 so that it cannot move. Alternatively, a valve, for example, the valve 60 from the previous embodiment, may form the first sealing element 43.

Figure 16:
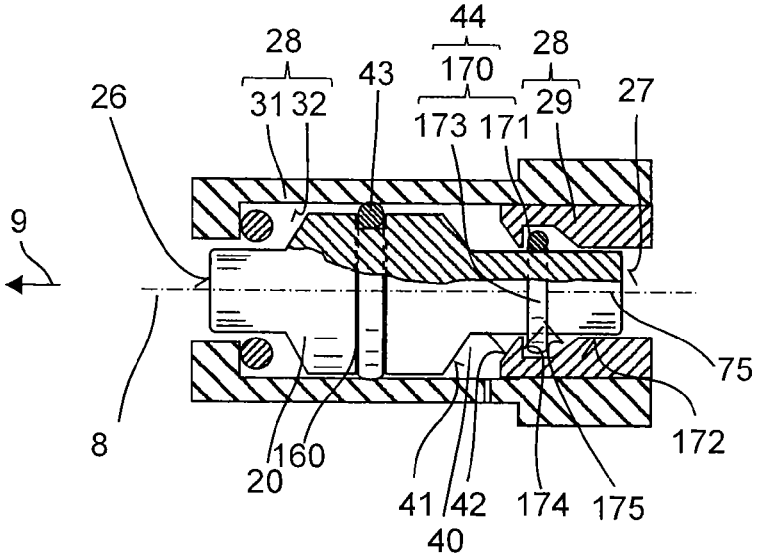
FIG. 16 illustrates a stationary striker brake.

FIG. 16 shows a longitudinal section of another embodiment with a valve 170 arranged in a stationary manner. The first sealing element 43 may be a sealing element that seals permanently or a valve. The valve 170 forms the second sealing element 44 by means of a groove 171, which is embedded in an inner wall 172 of the guide 28, and an annular sealing element 173, which is inserted into the groove 171, and encloses the rear section 75 of the striker 20. The groove 171 is arranged axially against the impact direction 9 of the rear limit stop 29. A forward groove wall 174 of the groove 171 is essentially perpendicular to the axis 8, while the rear groove wall 175 of the groove 171 is inclined with respect to the axis 8. The rear groove wall 175 runs radially inwardly against the impact direction 9 radial. The valve 170 blocks when air flows out of the pneumatic chamber 40, in that the sealing ring 173 is compressed radially by the diagonal rear groove wall 175 and presses against the striker 20.

Figure 17:
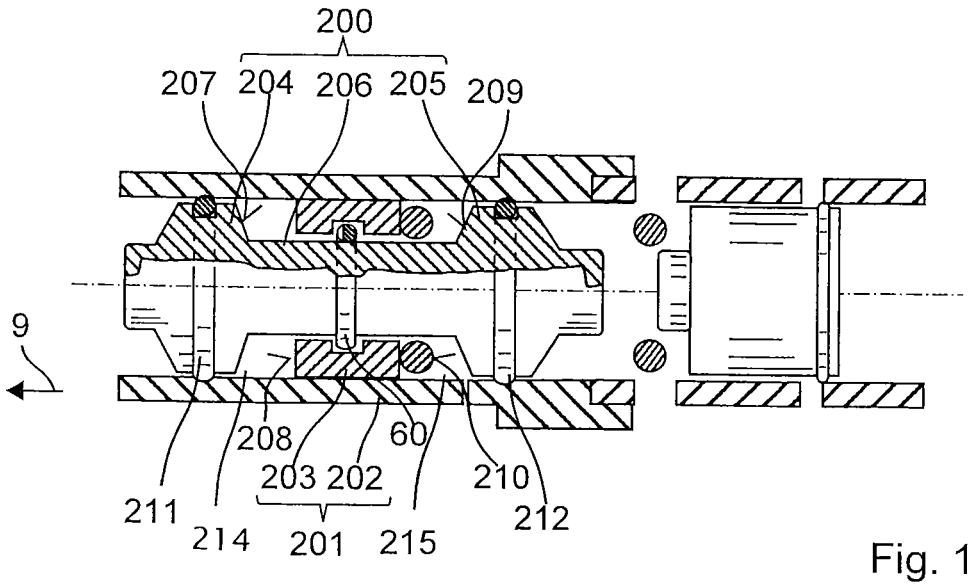
FIG. 17 illustrates a striker brake for a dumbbell-shaped striker.

FIG. 17 shows another embodiment with a differently designed striker 200 and an associated guide 201. The guide 201 has, for example, a cylindrical guide tube 202, in which the striker 200 slides. Inserted into the guide tube 202 is a sleeve 203, which locally reduces the inner cross-section of the guide tube 202. The striker 200 has a tapered center section 206 along the axis 8 between a forward section 204 and a rear section 205. The forward section 204 and the rear section 205 may form the impact surfaces 26, 27. The diameter of the center section 206 is adapted to the sleeve 203. The diameters of the forward and rear sections 204, 205, which are preferably equal in size, are adapted to the larger inner diameter of the guide tube 201. The forward section 204 is after the sleeve in the impact direction 9 and the rear section 205 is in front of the sleeve 203 in the impact direction 9. A radially running surface 207 of the forward section 204 pointing against the impact direction 9 together with a surface 208 of the sleeve 203 pointing in the impact direction 9 form the rear limit stop. The forward limit stop is formed by the rear section 205 and its radially running surface 209 pointing in the impact direction 9 and the surface 210 of the sleeve 203 pointing against impact direction.

The guide 201 is connected in an air-tight manner with the forward section 204 or the rear section 205 of the striker 200 in the radial direction by a forward sealing ring 211 and a rear sealing ring 212. A one-way valve 60 is arranged in the sleeve 203, which can seal the sleeve 203 with respect to the center section 206 of the striker 200 depending upon the movement direction of the striker 200. A forward pneumatic chamber 214 and a rear pneumatic chamber 215 are hereby defined, which are coupled via the valve 60. As in the foregoing embodiments, the valve 60 opens in the case of a movement of the striker 200 in the impact direction 9 and closes or throttles in the case of a movement of the striker 200 against the impact direction 9. The one-way valve 60 may be, for example, the valve 60 with a slotted, axially floating sealing ring 61, the valve 80 with a conical connecting member for a sealing ring, the valve with a flap valve, the valve with a gap sealing valve.

In one embodiment, only one pneumatic chamber is provided, wherefore the forward 211 or the rear sealing ring 212 is omitted or is arranged in a non-hermetically sealed manner for example.

Figure 18:
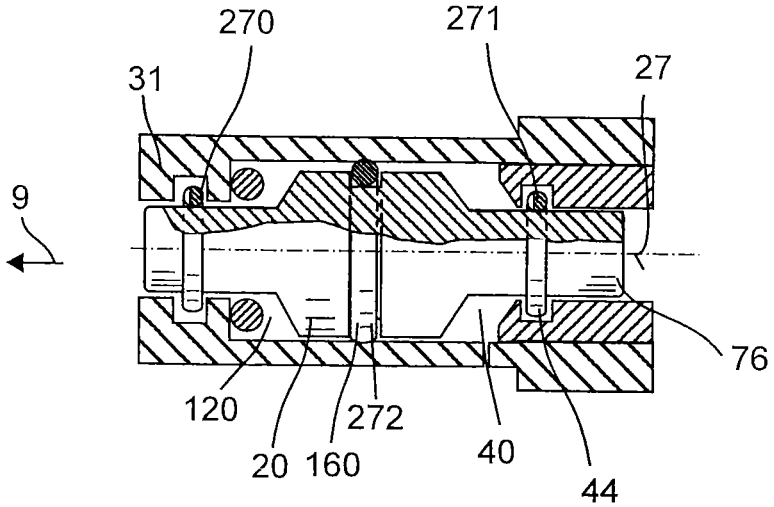
FIG. 18 illustrates a striker brake with two chambers and a stationary sealing element.

FIG. 18 shows another embodiment, in which two independent valves for two pneumatic chambers 40, 120 are provided. The pneumatic chambers 40, 120 are not linked.

In the depicted embodiment, the forward pneumatic chamber 120 is linked to the environment via a first valve 270. The first valve 270 blocks against air flowing into the forward pneumatic chamber 120. A second valve 271 links the rear pneumatic chamber 40 to the environment and is blocked for air flowing out of the rear pneumatic chamber 40. The two pneumatic chambers 40, 120 are separated by the first sealing element in the exemplary embodiment of a sealing ring 272, which is arranged axially between the two valves 270, 271. The two valves 270, 271 may be formed, for example, by the depicted one-way valve 160 or by other one-way valves.

Figure 19:
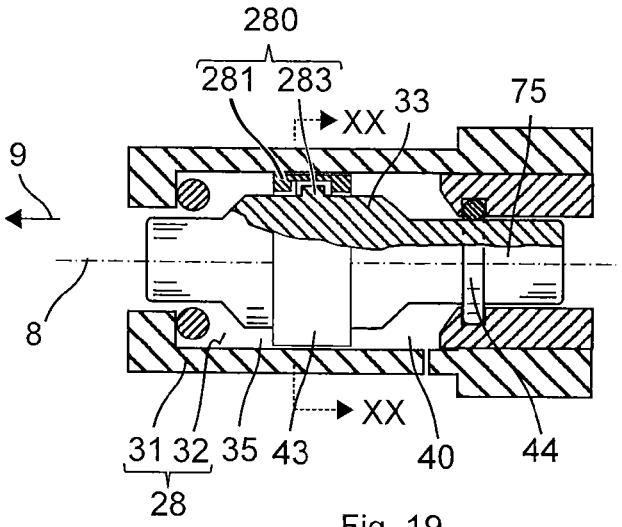
FIG. 19 is a longitudinal section of another striker brake.
Figure 20:
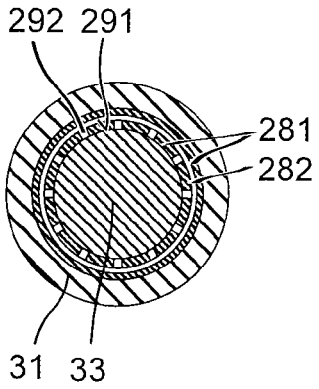
FIG. 20 is a cross-section along plane XX-XX of the striker brake from FIG. 19.
Figure 21:
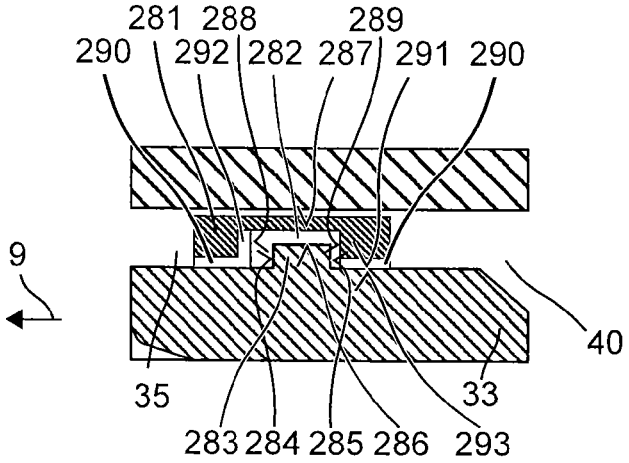
FIG. 21 is a detailed view of FIG. 19.

FIG. 19 shows another embodiment with a valve 280 in a longitudinal section through the striking mechanism 4, FIG. 20 shows a cross-section through the valve 280 in plane XX-XX and FIG. 21 shows an enlarged detailed representation. The thicker center section 33 has a radially projecting rib 283, which, for example, runs around the circumference in a closed manner. The sealing ring 281, which spans the center section 33, is put over the rib 283. The sealing ring 281 has a groove 282, in which the rib 283 engages. The groove 282 is wider than the rib 283 and a groove base 287 is spaced apart from a roof area 286 of the rib 283. The sealing ring 281 is preferably adjacent to a lateral area 293 of the center section 33 offset from the rib 283. Introduced in the sealing ring 281 are several axial running narrow channels 290 in a surface 291 facing the striker 20 such that the surface 291 together with the groove 292 forms at least one continuous axially running channel between the striker 20 and the sealing ring 281. Air may flow through the valve 280 along the axial narrow channels 290 and the groove 282.

The striker 20 may move along the axis 8 opposite from the sealing ring 281. In a first position, a forward face surface 284 of the rib 283 may be adjacent to a forward groove wall 288 of the groove 282. Several radially running narrow channels 292 are introduced in the groove wall 288. A flush closure of the forward face surface 284 and the forward groove wall 288 is hereby prevented. Between the forward groove wall 288 and the forward face surface 284, the radial narrow channels 292 form an air channel with a cross-sectional area that is not equal to zero. In the depicted embodiment, the forward face surface 284 of the rib 283 and the forward groove wall 288 are perpendicular to the axis 8. As an alternative, they may also be inclined with respect to the axis 8. In a second position, a rear face surface 285 of the rib 283 may be adjacent to a rear groove wall 289 of the groove 282. The rear face surface 285 and the rear groove wall 289 are preferably form-fitting, whereby an airflow between the two surfaces in the second position may be prevented.

The sealing ring 281 is axially moveable in the guide 28, i.e., the guide tube 31. In the case of a forward-moving striker 20, the sealing ring 281 is carried along, whereby the forward face surface 284 is adjacent to the forward groove wall 288 (first position). In the pneumatic chamber 40, air may flow along a flow channel, which is formed by the axial narrow channels 290, the radial narrow channels 292 along the forward groove wall 288 and the forward face surface 284, the hollow space between the groove base 287 and the roof area 286 of the rib 283, and the spaced-apart rear groove wall 289 and rear face surface 285 of the rib 283. In the case of a backward-moving striker 20, the sealing ring 281 is likewise carried along, whereby the rear face surface 285 is now adjacent to the rear groove wall 289. The sealing ring 281 is preferably flush, hermetically sealed, on the inner wall 32 of the guide tube 31, thereby constricting the flow channel of the valve 280. The cross-section of the flow channel is now determined by the two adjacent rear surfaces.

In one embodiment, the radially running narrow channels 292 are arranged alternatively or additionally in the forward face surface 284 of the rib 283.

The pneumatic chamber 40 may be closed by the second sealing element 44, preferably a permanently sealing, immobile sealing ring, which encloses a rear end 75 of the striker 20.

Figure 22:
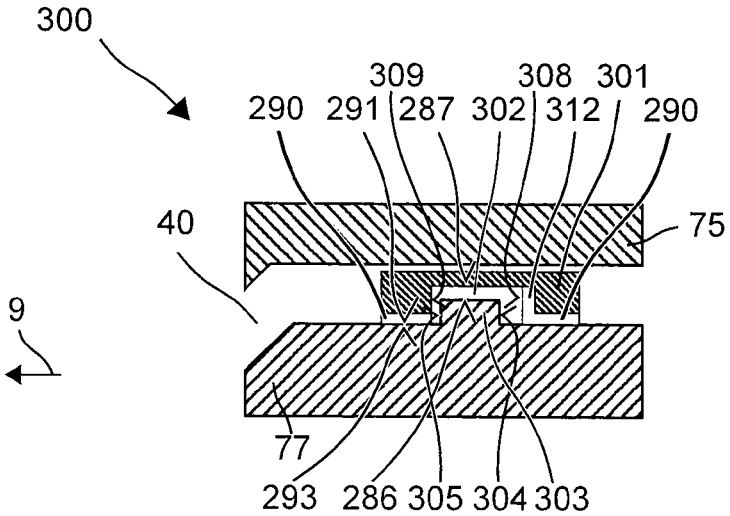
FIG. 22 is a detailed view of another valve for a striker brake.

FIG. 22 shows a detailed view of a stationary valve 300 on the sleeve 77. The sleeve 77 has a projecting rib 303, over which a moveable sealing ring 301 with a groove 302 is put. As opposed to the embodiment depicted in FIGS. 19 to 21, the arrangement of the sealing ring 301 is disposed in a mirrored manner to a plane perpendicular to the axis 8. A groove wall 308 with radially running narrow channels 312 is opposite from a rear face surface 304 of the rib 303. The rear face surface 304 points away from the pneumatic chamber 40. A forward groove wall 309 is preferably smooth and is opposite from a flush-terminating forward face surface 305 of the rib 303. The sealing ring 301 is moved by the airflow into and out of the pneumatic chamber 40. An airflow into the pneumatic chamber 40 pushes the sealing ring in the direction of the pneumatic chamber 40, whereby the rear surfaces with the radial narrow channels 312 are adjacent to one another. The valve 300 is open. An airflow out of the pneumatic chamber 40 pushes the sealing ring 301 away from the pneumatic chamber 40, whereby the two flush-terminating forward surfaces 305, 309 are adjacent to one another. The valve 300 is closed.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A power tool, comprising:

a striker;

a guide tube in which the striker is guided along an axis; and a pneumatic chamber which is closed by the striker, the guide tube, and a valve device, wherein a volume of the pneumatic chamber is variable based on a movement of the striker along the axis;

wherein, in a flow channel between the striker and the guide tube, the valve device has a sealing element that is moveable between a first position and a second position in a bearing along the axis;

wherein the flow channel has a first cross-sectional area in the first position adjacent to a first mating surface of the bearing, wherein the flow channel has a second cross-sectional area in the second position adjacent to a second mating surface of the bearing offset from the first mating surface along the axis, and wherein the second cross-sectional area is greater than the first cross-sectional area;

wherein the bearing is formed by a groove in the striker or a groove in the guide tube and wherein the sealing element is axially moveable in the groove between the first mating surface formed by a first groove wall and the second mating surface formed by a second groove wall.

2. The power tool according to claim 1, wherein the flow channel runs between the first mating surface of the bearing and a first mating surface of the sealing element assigned to the first mating surface of the bearing and between the second mating surface of the bearing and a second mating surface of the sealing element assigned to the second mating surface of the bearing.

3. The power tool according to claim 1, wherein the second mating surface of the bearing and/or a mating surface of the sealing element assigned to the second mating surface of the bearing have narrow channels running radially perpendicularly to the axis at least in part.

4. The power tool according to claim 1, wherein the groove and the sealing element run annularly around the axis and, in the first position, the sealing element touches the guide tube and the striker along a closed line around the axis.

5. The power tool according to claim 1, wherein the first groove wall is inclined with respect to the axis by less than 60 degrees and the second groove wall is inclined with respect to the axis by at least 80 degrees.

6. The power tool according to claim 1, wherein the striker has a prismatic first section and a prismatic second section with a larger cross-sectional area as compared to the first section and wherein the valve device is arranged on the second section of the striker.

7. The power tool according to claim 1, wherein a seal between the striker and the guide tube and offset from the valve device is provided along the axis, wherein the valve device and the seal are arranged at different distances from the axis.

8. The power tool according to claim 1, wherein the first cross-sectional area of the flow channel is a maximum of one hundredth of the second cross-sectional area of the flow channel.

9. The power tool according to claim 1, further comprising a throttle which connects the pneumatic chamber with an air reservoir, wherein a cross-sectional area of the throttle corresponds to a maximum of one hundredth of the second cross-sectional area.

10. The power tool according to claim 1, further comprising a throttle which connects the pneumatic chamber with an air reservoir, wherein an effective cross-sectional area of the pneumatic chamber is greater than a hundred times a cross-sectional area of the throttle.

11. The power tool according to claim 1, wherein an effective cross-sectional area of the pneumatic chamber is greater than a hundred times the first cross-sectional area.

12. The power tool according to claim 11, wherein the first mating surface of the bearing and/or a mating surface of the sealing element assigned to the first mating surface of the bearing has narrow channels running radially perpendicularly to the axis at least in part, and a total of their cross-sectional area is less than one hundredth of the effective cross-sectional area of the pneumatic chamber.

13. The power tool according to claim 1, further comprising a pneumatic spring defined between an exciter piston and an impacting piston, wherein the impacting piston is contactable on the striker.

* * * * *